US009642506B2

(12) United States Patent
Todokoro

(10) Patent No.: US 9,642,506 B2
(45) Date of Patent: May 9, 2017

(54) AUXILIARY TOILET SEAT

(71) Applicant: AGATSUMA CO., LTD, Tokyo (JP)

(72) Inventor: Shinji Todokoro, Tokyo (JP)

(73) Assignee: AGATSUMA CO., LTD., Tokyo (JP)

( * ) Notice: Subject to any disclaimer, the term of this patent is extended or adjusted under 35 U.S.C. 154(b) by 151 days.

(21) Appl. No.: 14/629,900

(22) Filed: Feb. 24, 2015

(65) Prior Publication Data

US 2015/0245749 A1 Sep. 3, 2015

(30) Foreign Application Priority Data

Feb. 28, 2014 (JP) ..... 2014-038843

(51) Int. Cl.
*A47K 13/06* (2006.01)

(52) U.S. Cl.
CPC ..... *A47K 13/06* (2013.01)

(58) Field of Classification Search
CPC ..... A47K 13/06; A47K 13/00; A47K 13/005; A47K 13/14; A47K 11/04; A47K 11/06
USPC ..... 4/237, 239, 245.3, 245.5, 483, 902
See application file for complete search history.

(56) References Cited

U.S. PATENT DOCUMENTS 4,457,029 A * 7/1984 Matthews ..... A47K 13/00 4/237
5,191,660 A * 3/1993 Francke ..... A47K 13/005 297/352
5,412,815 A * 5/1995 Ellis ..... A47K 13/005 4/237
5,685,029 A * 11/1997 Gee ..... A47K 11/06 4/239
6,698,036 B2 * 3/2004 Armbruster ..... A47K 11/06 4/483
7,823,228 B2 * 11/2010 Todokoro ..... A47K 13/06 4/239
2007/0113328 A1 * 5/2007 Cheng ..... A47K 13/005 4/239
2007/0294811 A1 * 12/2007 Todokoro ..... A47K 13/06 4/237
2010/0050328 A1 * 3/2010 Hennington ..... A47K 13/005 4/237
2014/0259338 A1 * 9/2014 Welch ..... A47K 13/06 4/239
2015/0297044 A1 * 10/2015 McCarthy ..... A47K 17/00 4/300

* cited by examiner

*Primary Examiner* — J. Casimer Jacyna
(74) *Attorney, Agent, or Firm* — The Marbury Law Group, PLLC

(57) ABSTRACT

There is provided an auxiliary toilet seat with which a toddler can sit astride or sit in a posture like sitting on a chair. An auxiliary toilet seat main body of an auxiliary toilet seat is formed substantially oval. A seating surface of the auxiliary toilet seat main body is formed substantially flat. A splash prevention part is formed at each front and rear part of an inner peripheral part of the auxiliary toilet seat main body. An abutting fixing part having fixing position adjusting means is provided to each of two positions in a front part and rear part on a bottom surface of the auxiliary toilet seat main body. The auxiliary toilet seat is abuttable against a bottom surface of a toilet seat of a western style adult toilet bowl to be fixedly attached to the bottom surface.

6 Claims, 8 Drawing Sheets

AUXILIARY TOILET SEAT

CROSS-REFERENCE TO RELATED APPLICATION

This application is based upon and claims the benefit of priority under 35 USC 119 of Japanese Patent Application No. 2014-38843 filed on Feb. 28, 2014, the entire disclosure of which, including the description, claims, drawings, and abstract, is incorporated herein by reference in its entirety.

FIELD OF THE INVENTION

The present invention relates to an auxiliary toilet seat for toddlers. More specifically, the present invention relates to an auxiliary toilet seat that can be installed on a toilet seat of a western style toilet bowl.

BACKGROUND OF THE INVENTION

General toilet bowls installed in such as houses are too large in size for toddlers to use them. Therefore potty chairs have been used for the toddlers when they excrete. In addition, western style toilet bowls have been common these days. In order to allow the toddlers to utilize the western style toilet bowls, there have been used auxiliary toilet seats installed on a toilet seat of the western style toilet bowls. There are western style toilet bowls in various shapes and sizes. Therefore, the auxiliary toilet seats have adjustable fixing means so as to be fixed onto the toilet seat of the western style toilet bowls.

For example, publication of Japanese utility model registration number 3125037 discloses an auxiliary toilet seat for a toddler that includes first leg parts on a bottom surface thereof for abutting against a top surface of the toilet seat of the western style toilet bowl. Third leg parts are fixedly provided to a rear part of the bottom surface of the auxiliary toilet seat, which protrude downward so as to be abuttable against a bottom surface of the toilet seat of the western style toilet bowl. In addition, second leg parts are provided in a front part of the bottom surface of the auxiliary toilet seat as fixing means, which are formed adjustable so as to abut against an inner edge of the toilet seat of the western style toilet bowl to be fixed thereto. A handle is formed in a front part of the seating surface of the auxiliary toilet seat so as to be gripped by the toddler when being used.

When the toddler uses the auxiliary toilet seat disclosed in the publication of Japanese utility model registration number 3125037, the toddler sits astride the auxiliary toilet seat. At this time, the toddler also has to straddle the western style toilet bowl under the auxiliary toilet seat simultaneously, and this requires the toddler to open his/her legs widely when sitting on the auxiliary toilet seat. There are some toddlers who cannot excrete well or are unwilling to sit on the auxiliary toilet seat with their legs wide open. It is difficult to use the auxiliary toilet seat for such toddlers. In addition, when sitting astride the auxiliary toilet seat, the toddler has to take off his/her trousers and undergarment, which requires extra labor.

SUMMARY OF THE INVENTION

The present invention is made to eliminate the aforementioned problems and realizes an auxiliary toilet seat that can be installed to a toilet seat so that a toddler can sits astride or sits without straddling the auxiliary toilet seat.

According to an aspect of the invention, there is provided an auxiliary toilet seat including: an auxiliary toilet seat main body which is formed substantially oval and which has a seating surface in a longitudinal direction which is formed flat; a handle provided only in a front part of the seating surface; a support part formed on a bottom surface of the auxiliary toilet seat main body for supporting the auxiliary toilet seat main body by abutting against a toilet seat surface of an adult toilet bowl when the auxiliary toilet seat is set on the adult toilet bowl; a bar-like abutting member provided to each of two positions in a front part and rear part of the bottom surface of the auxiliary toilet seat main body, having a bar-like part formed into vertically long bar-like shape so as to be abuttable against an inner edge of the adult toilet seat, and an abutting part projecting from a bottom end of the bar-like part so as to be abuttable against the bottom surface of the adult toilet seat; and fixing position adjusting means formed such that a fixing position of the each bar-like abutting member is adjustable by being moved.

According to another aspect of the invention, there is provided an auxiliary toilet seat, in which the fixing position adjusting means includes: a gear part fixedly provided to an upper end side of the bar-like abutting member; a guide member provided to above the gear part for abutting against the bottom surface of the auxiliary toilet seat main body and for guiding the bar-like abutting member rotatably around an axis thereof and vertically; an elastic member for biasing the guide member and the gear part in a separating direction; a cover part fixedly provided to the bottom surface of the auxiliary toilet seat main body, having a guide hole for guiding the bar-like abutting member in a moving direction, and formed into a flat plate-like shape for restricting a downward movement of the bar-like abutting member by abutting against the gear part; and a meshing part which is formed on a top surface of the cover part at both sides of the gear part and which is formed into a rack-like shape extending in the moving direction of the bar-like abutting member so as to mesh detachably with the gear part.

In addition, a top end of a tooth of the meshing part is formed into a slanted shape.

Further, a splash prevention part formed into outwardly curved dome-like convex shape is provided in each front part and rear part of an inner edge part of a top surface of the auxiliary toilet seat main body. The splash prevention part of the front part is made higher than the splash prevention part of the rear part viewed from a side.

The auxiliary toilet seat of the present invention is provided with the handle in the front part of the seating surface thereof and the seating surface in the longitudinal direction is formed substantially flat. The bar-like abutting member for fixing the auxiliary toilet seat to the toilet seat of the western style toilet bowl, which is the adult toilet bowl, is provided to each of two positions in a front part and rear part of the auxiliary toilet seat. The bar-like abutting member is designed to be movably fixed by fixing position adjusting means.

By doing this, the auxiliary toilet seat of the present invention can be installed to the toilet seat of the western style adult toilet bowl with a front side having the handle part being positioned forward, and also be installed with the front side having the handle part being positioned rearward.

When the auxiliary toilet seat is installed to the toilet seat of the western style adult toilet bowl with the front side having the handle part being positioned forward, the toddler can sit astride the auxiliary toilet seat as is conventionally done. On the other hand, when the auxiliary toilet seat is installed to the toilet seat of the western style adult toilet bowl with the front side having the handle part being positioned rearward, the toddler can sit in a posture like sitting on a chair with his/her legs closed, without needing to take off his/her trousers and undergarment.

In this way, as the auxiliary toilet seat can be used for both sitting astride and sitting like the chair, a sitting posture can be chosen according to each toddler's preference, whereby grizzling of the toddler when excreting can be reduced. This encourages the toddler's healthy growth and relieves burden of parenting on a parent when taking care of the toddler.

In addition, the fixing position adjusting means includes the gear part provided to the bar-like abutting member and the meshing part which is provided at both sides of the gear part and which is formed into the rack-like shape extending in the moving direction of the bar-like abutting member so as to mesh with the gear part. The bar-like abutting member is formed so as to be biased downward. By doing this, the bar-like abutting member can be moved by being pushed upward. The bar-like abutting member can then be fixed by removing a hand from the bar-like abutting member.

With this design, the fixing position adjusting means can be formed with a simple structure. When the auxiliary toilet seat is installed in either direction, forward or rearward, fixing operation of the bar-like abutting member is the same and this facilitates easier installation of the auxiliary toilet seat.

The top end of the tooth of the meshing part is formed into a slanted shape. By doing this, the tooth of the gear part is guided smoothly into between teeth of the meshing part when the hand pushing the bar-like abutting member upward is removed, whereby the bar-like abutting member is firmly fixed.

Further, the splash prevention part for preventing splash of excreted urine is provided in each front and rear parts of the inner edge part of the auxiliary toilet seat main body formed substantially oval. The splash prevention part of the front part is formed higher in height than the splash prevention part of the rear part. With this design, when a boy uses the auxiliary toilet seat, who tends to sit astride the auxiliary toilet seat installed facing forward, the splash of the excreted urine is completely prevented, and when a girl uses the auxiliary toilet seat, who tends to sit on the auxiliary toilet seat installed facing rearward, the splash of the excreted urine is sufficiently prevented without encumbering her sitting posture.

BRIEF DESCRIPTION OF THE SEVERAL VIEWS OF THE DRAWINGS

FIG. 5A shows a state in which the bar-like abutting member is fixed, and FIG. 5B shows a state in which the bar-like abutting member is allowed to be moved.

FIG. 7A shows the auxiliary toilet seat installed with the handle part facing forward, FIG. 7B shows the auxiliary toilet seat installed with the handle part facing rearward.

DETAILED DESCRIPTION

Hereinafter, a best mode for carrying out the invention will be described by the use of the accompanying drawings. Although the following embodiments have various preferred technical limitations for carrying out the invention, those technical limitations are not intended to limit the scope of the invention to the embodiments and illustrated examples.

Embodiments of an auxiliary toilet seat 10 of the present invention will be described with reference to FIGS. 1 to 8.

Figure 1:
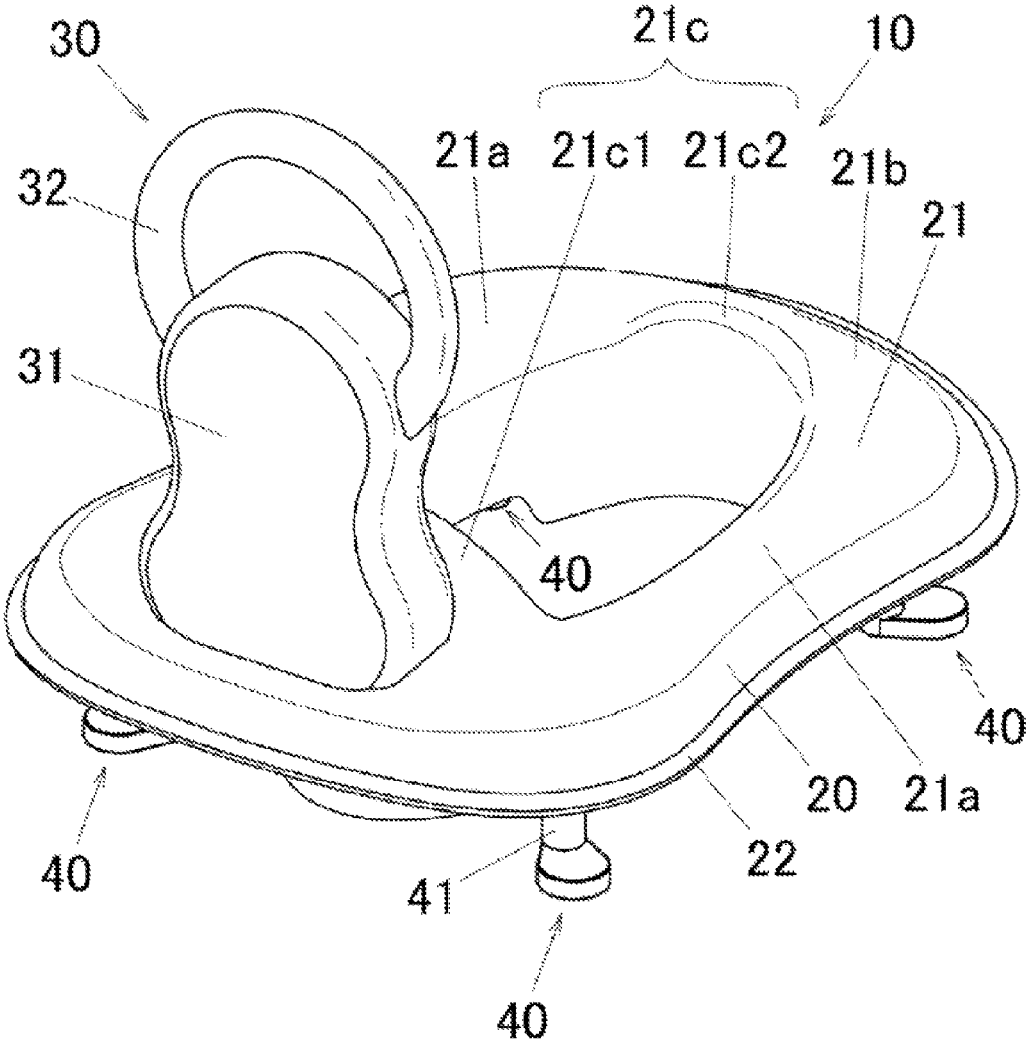
FIG. 1 is a front perspective view of an auxiliary toilet seat of the present invention.

FIG. 1 is a perspective view when viewing an auxiliary toilet seat 10 from the front upper left side. In descriptions hereinafter, a handle part 30 side is referred to as a front direction, and its opposite side is referred to as a rear direction. In addition, a seating surface 21 side is referred to as a top direction, and its opposite side is referred to as a bottom direction. Further, when sitting on the auxiliary toilet seat with a handle part 30 positioned forward, a right hand side is referred to as a right direction, and a left hand side is referred to as a left direction. All members of the auxiliary toilet seat 10, excluding such as screws and springs, are made of resin material by injection molding method.

In FIG. 1, the auxiliary toilet seat 10 includes an auxiliary toilet seat main body 20, which has a seating surface 21. The handle part 30 is provided in a front part of a top surface of the auxiliary toilet seat main body 20 in a standing manner. When the auxiliary toilet seat 10 is installed to a toilet seat of a western style adult toilet bowl with the handle part 30 being positioned forward, the toddler can sit astride the auxiliary toilet seat 10 with gripping the handle part 30. When the auxiliary toilet seat 10 is installed to a toilet seat of a western style adult toilet bowl with the handle part 30 being positioned rearward, the toddler can sit on the auxiliary toilet seat 10 in a sitting-like posture without opening legs wide.

An abutting fixing part 40 having a bar-like abutting member 41 provided in a downwardly standing manner is provided to each of two positions in a front part and rear part, namely four positions in total, on the bottom surface of the auxiliary toilet seat main body 20. In the abutting fixing part 40, the bar-like abutting member 41 is installed to the auxiliary toilet seat main body 20 by fixing position adjusting means 60 (see FIG. 2) for adjusting a fixing position by moving the bar-like abutting member 41 in back-and-forth direction. The auxiliary toilet seat main body 20 is formed substantially oval which is longer in a longitudinal direction. The seating surface 21 is formed on the top surface of the auxiliary toilet seat main body 20. A buttock supporting seating surface 21*a* is provided to each right and left side of the seating surface 21 in the longitudinal direction and is formed substantially flat. A center portion of a fringe area of the each buttock supporting seating surface 21*a* is curved inward so as to be formed narrow in width. A rear seating surface 21*b* for connecting continuously the buttock supporting seating surfaces 21*a* on both sides is also formed substantially flat.

The splash prevention part 21*c* for preventing splash of excreted urine is provided in each front part and rear part of an inner edge part of the auxiliary toilet seat main body 20. A front splash prevention part 21*c*1 formed in the front part is formed into forwardly/outwardly curved convex shape as if about two-third of a hemispherical dome is cut therefrom. A rear splash prevention part 21*c*2 formed in the rear part is also formed into rearwardly/outwardly curved convex shape as if about two-third of the hemispherical dome is cut therefrom. The front splash prevention part 21*c*1 is formed taller in height and wider in width than the rear splash prevention part 21*c*2.

The handle part 30 is provided in a front part of the seating surface 21 of the auxiliary toilet seat main body 20 in a standing manner. The handle part 30 is configured by a handle support part 31, which is provided in the front part of the seating surface 21 in the standing manner and a handle member 32 which is formed in a toric shape and which is provided to an upper part of the handle support part 31. A periphery guard 22 is provided to an outer periphery of the auxiliary toilet seat 20 in order not to damage the seating surface of the western style adult toilet bowl when the auxiliary toilet seat 20 is installed to the seating surface of the western style adult toilet bowl.

Figure 2:
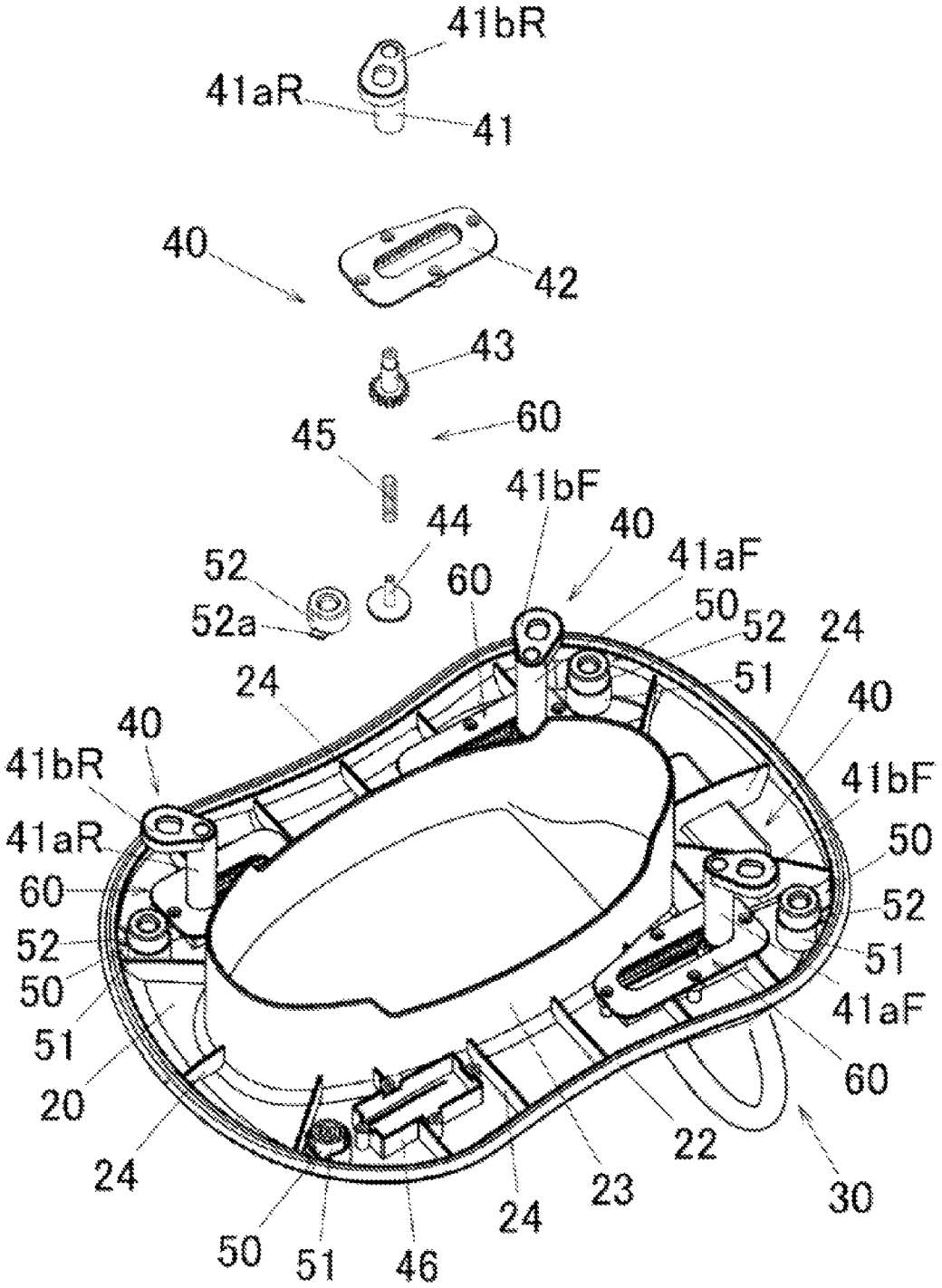
FIG. 2 is a bottom perspective view of the auxiliary toilet seat of the present invention.

Next, a description hereinafter will be made with reference to FIG. 2. FIG. 2 is a perspective view when viewing the auxiliary toilet seat main body 20 from the lower side. A urine guard 23 formed cylindrical is downwardly erected along the inner edge part of the auxiliary toilet seat 20 in such a way as to copy an oval of the inner edge part. The urine guard 23 guides excretions and prevents the excretions from splashing around.

A supporting leg part 50 is provided to each of two positions in the front part and rear part, namely four positions in total, on the bottom surface of the auxiliary toilet seat main body 20. A supporting leg part 50 supports the auxiliary toilet seat 10 by abutting against the seating surface of the western style adult toilet bowl when the auxiliary toilet seat 10 is installed to the seating surface of the western style adult toilet seat. The supporting leg part 50 includes a leg part member 52 formed into a truncated cone shape that is provided to an outer periphery step portion of a leg portion base 51 which projects downwardly from the bottom surface of the auxiliary toilet seat main body 20. A connection part 52*a* projecting from an outer periphery of a lower part of the leg part member 52 connects the periphery guard 22 and the leg part member 52 to form them integrally. Namely, the leg part member 52, periphery guard 22, and connection part 52*a* are formed together with the auxiliary toilet seat main body 20 by two-color forming (double molding method), using material whose hardness is lower than hardness of a material of the auxiliary toilet seat main body 20.

An abutting fixing part 40 is provided to each of two positions in the front part and rear part, namely four positions in total, on the bottom surface of the auxiliary toilet seat main body 20, as heretofore described. As shown in an exploded perspective view of the abutting fixing part 40 in a rear left position of the auxiliary toilet seat 10 in FIG. 2, the abutting fixing part 40 is made up of the bar-like abutting member 41 and the fixing position adjusting means 60. The fixing position adjusting means 60 is made up of a cover member 42 having a meshing part 42*c*, a connection supporting member 43, a guide member 44, and a compression coil spring 45, which is an elastic member. The abutting fixing part 40 is installed to the auxiliary toilet seat main body 20 via a fixed installation part 46, which is downwardly erected from the bottom surface of the auxiliary toilet seat main body 20. A structure of the abutting fixing part 40 is described later. A plurality of ribs 24 is formed in a radial manner on the bottom surface of the auxiliary toilet seat main body 20 for reinforcement.

Figure 3:
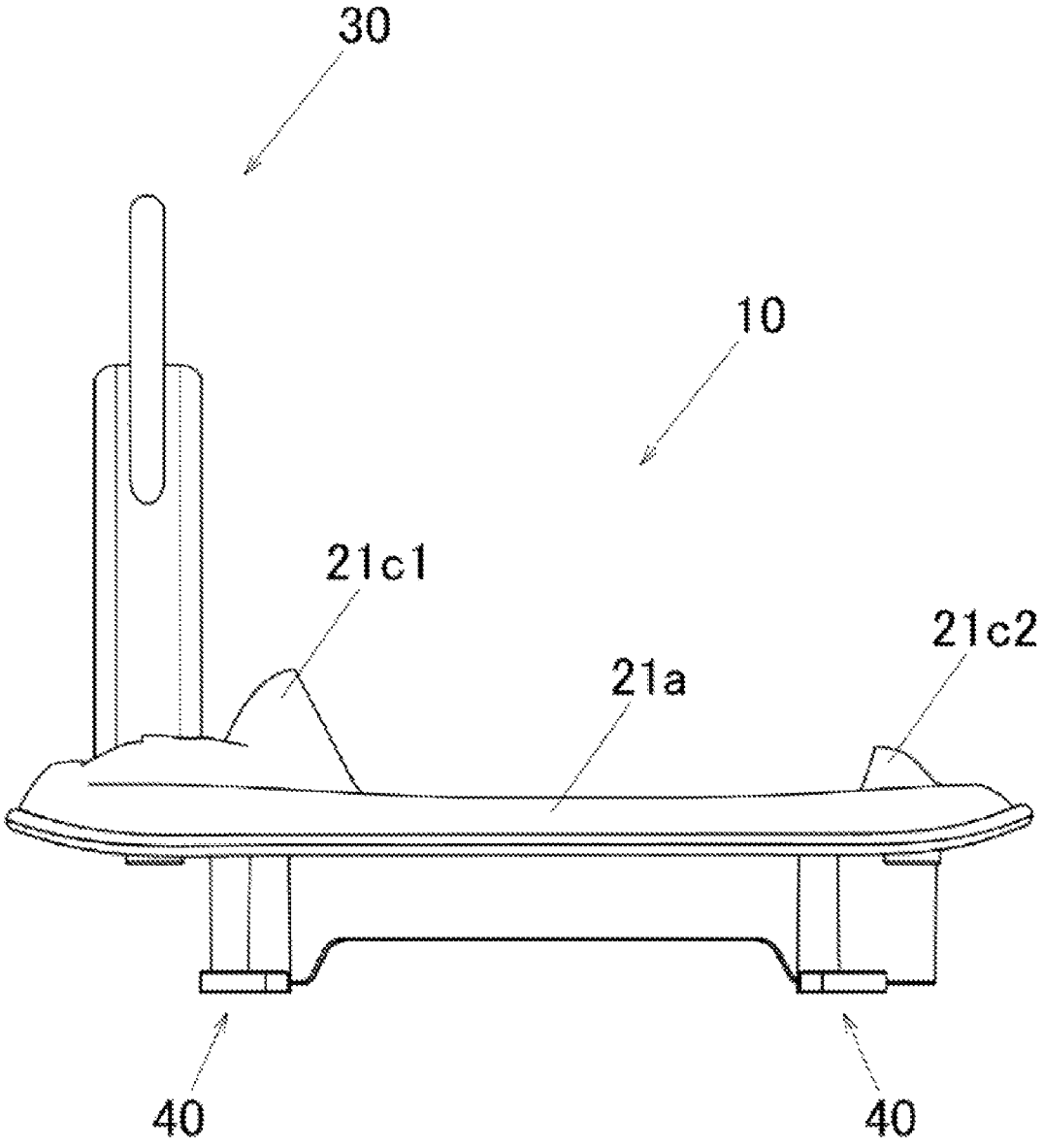
FIG. 3 is a side view of the auxiliary toilet seat of the present invention.

FIG. 3 is the side view of the auxiliary toilet seat 10. The buttock supporting seating surface 21*a* on which toddler's buttocks sit is formed substantially flat. However, when microscopically viewing the buttock supporting seating surface 21*a*, the buttock supporting seating surface 21*a* is formed as being gradually curved downwards so that a substantially center portion in the longitudinal direction is lower than front and rear ends. By doing this, the toddler's buttocks can fit the auxiliary toilet seat 10 when sitting thereon. The front splash prevention part 21*c*1 is formed taller in height than the rear splash prevention part 21*c*2. The front splash prevention part 21*c*1 is formed about twice the height of the rear splash prevention part 21*c*2.

The front and rear splash prevention parts 21*c* are different in height as described. However, both the front splash prevention part 21*c*1 and rear splash prevention part 21*c*2 have splash preventing function in urination. Boys prefer sitting astride with gripping the handle part 30. Therefore, the front splash prevention part 21*c*1 that is taller than the rear splash prevention part 21*c*2 is more effective. On the other hand, girls prefer sitting in the posture like sitting on a chair more than boys. Therefore, even the rear splash prevention part 21*c*2 that is smaller than the front splash prevention part 21*c*1 is sufficiently effective to prevent girls from splashing urine. In addition, the rear splash prevention part 21*c*2 should be as small as possible so as not to disturb the toddlers since the rear splash prevention part 21*c*2 is located at a position of a crotch of the toddlers when they are in the posture like sitting on the chair.

Figure 4:
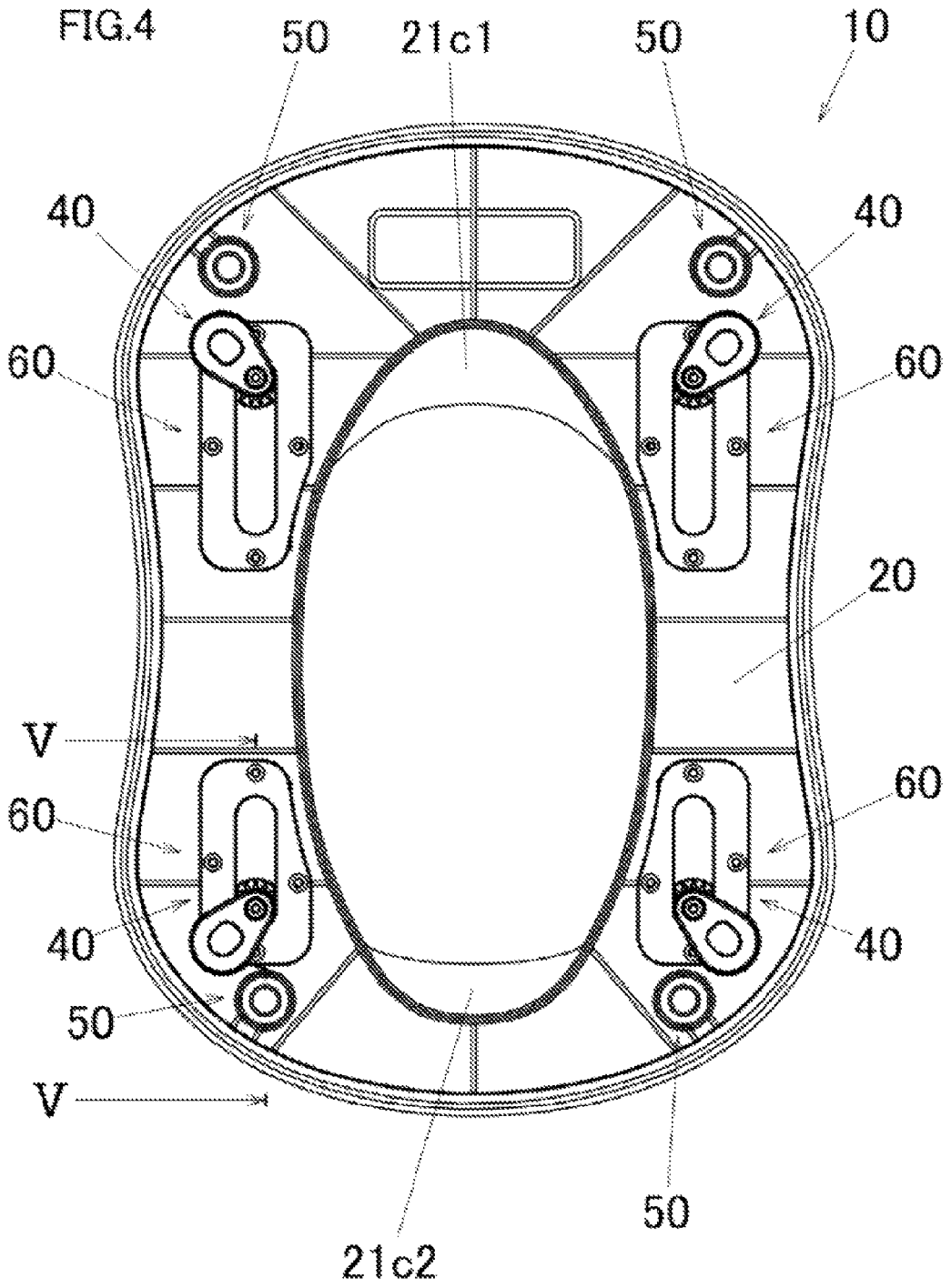
FIG. 4 is a bottom view of the auxiliary toilet seat of the present invention.

FIG. 4 is the bottom view of the auxiliary toilet seat 10. A contour of the auxiliary toilet seat main body 20 is formed substantially oval which is longer in longitudinal direction. An outline of the auxiliary toilet seat main body 20 is shaped as a vicinity of a center part thereof being curved inward. By doing this, the outline of front and rear sides of the auxiliary toilet seat main body 20 projects right and left directions, and each of front/rear parts and right/left parts of the outline are formed symmetry. Consequently, the auxiliary toilet seat main body 20 is comfortable to sit in facing either direction. In addition, as described above, the abutting fixing part 40 and the supporting leg part 50 are provided to each of two positions in the front part and rear part, namely four positions in total. The abutting fixing part 40 includes the fixing position adjusting means 60. In the abutting fixing part 40, the bar-like abutting member 41 is configured so as to be adjusted by being moved in back-and-forth direction and to be fixed by the fixing position adjusting means 60.

Figure 5A:
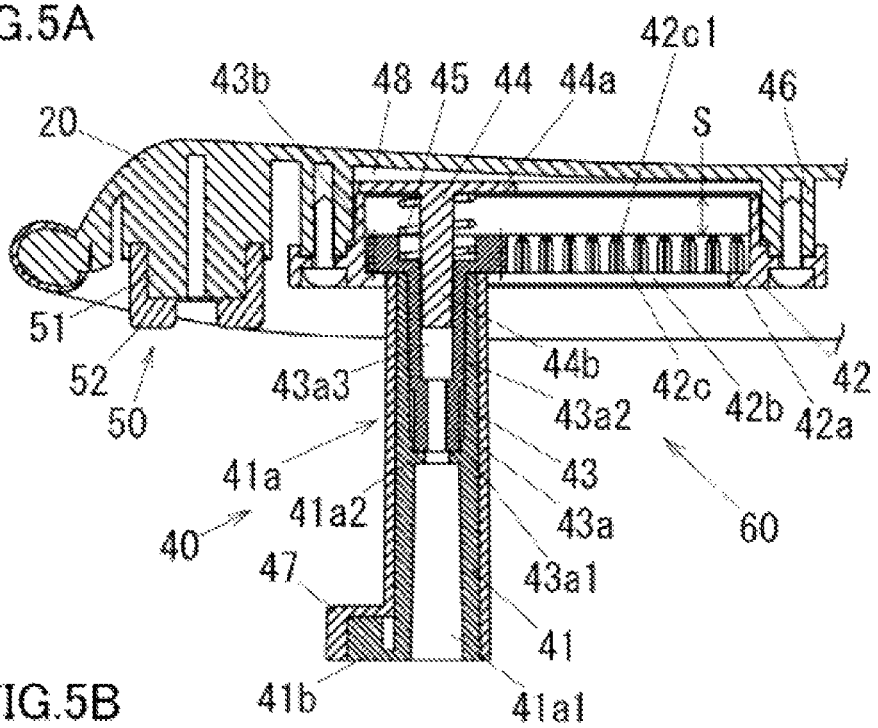
FIG. 5A, 5B are cross sectional views of the auxiliary toilet seat of the present invention taken along line V-V of FIG. 4 showing operation of a bar-like abutting member.
Figure 5B:
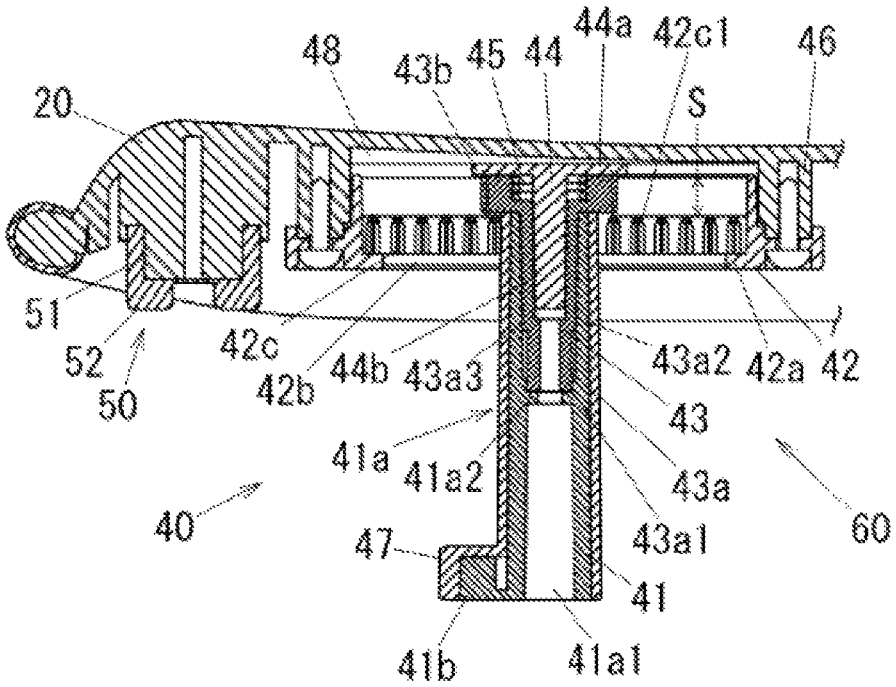

Next, the structure and operation of the abutting fixing part 40 is described in detail with reference to FIGS. 5A and 5B. FIGS. 5A and 5B are cross sectional views taken along line V-V of FIG. 4. FIG. 5A shows a state in which the bar-like abutting member 41 is fixed, and FIG. 5B shows a state in which the bar-like abutting member 41 is allowed to be moved. The bar-like abutting member 41 downwardly provided to the auxiliary toilet seat main body 20 is formed such that its longitudinal section is substantially L-shaped. The bar-like abutting member 41 includes a bar-like part 41*a* that downwardly extends in a long bar-like shape and an abutting part 41*b* that projects laterally from the bottom end of the bar-like part 41*a*. As shown in FIG. 4, an outline of the abutting part 41*b* in plan view is formed in such a shape that a large diameter circle positioned off-center from an axis of the bar-like part 41*a* and a small diameter circle positioned concentrically with the bar-like part 41*a* are connected with each other by tangent lines. A rectangular recess in plan view is provided to a portion of the large diameter circle. The bar-like part 41*a* has a through hole 41*a*1 which penetrates the bar-like part 41*a* in a vertical direction, as shown in FIG. 5A, 5B. An annular step part 41*a*2 is formed at an intermediate position of the through hole 41*a*1 in an up and down direction.

The connection supporting member 43 is made up of a shaft part 43*a* whose contour is formed into a circular shape in a cross section, and a gear part 43*b* formed into a spur gear shape, integrally. The shaft part 43*a* is fit into the bar-like part 41*a* of the bar-like abutting member 41. In the shaft part 43*a*, a distal end side thereof is formed as a small diameter part 43*a*1 and a proximal end side thereof (a gear part 43*b* side, in other words) is formed as a large diameter part 43*a*2. The large diameter part 43*a*2 of the shaft part 43*a* is formed into a tapered shape whose diameter becomes gradually larger toward the proximal end side. Because of this, the large diameter part 43*a*2 of the shaft part 43*a* is fit into the through hole 41*a*1 at proximal end side of the bar-like part 41*a* rigidly by a wedge effect. In the connection supporting member 43, an end of the bar-like part 41*a* of the bar-like abutting member 41 is fixed so as to abut against the gear part 43*b*. In this way, the bar-like abutting member 41 and the connection supporting member 43 are assembled integrally.

The guide member 44 is arranged above the connection supporting member 43. The guide member 44 includes a base plate 44*a* formed into a disc-like shape and a guide part 44*b* extending downward from the base plate 44*a*. A top surface of the base plate 44*a* is located between two rail parts 48 and abuts against each the two rail parts 48 which are formed on the bottom surface of the auxiliary toilet seat main body 20 and which extend in parallel with each other longitudinally like a rail shape, so that the guide member 44 can be moved parallel. The guide part 44*b* is a rod-like body whose cross-section is a circular. The guide part 44*b* is slidably inserted into a hole part 43*a*3 provided to the shaft part 43*a* of the connection supporting member 43. With this design, the bar-like abutting member 41 is slidably guided in a up-and-down direction by the guide member 44.

The bar-like abutting member 41 is rotatably supported around an axial center of the guide part 44*b*. The compression coil spring 45, which is an elastic member, is disposed between the base plate 44*a* of the guide member 44 and the gear part 43*b* of the connection supporting member 43 by being wound around an outer periphery of the guide part 44*b*. The compression coil spring 45 biases the guide member 44 and the bar-like abutting member 41 in a separating direction. An external surface of the bar-like abutting member 41, other than a portion of a bottom surface of the abutting part 41*b*, is coated with a soft resin coating 47 so as not to damage the toilet seat of the western style adult toilet bowl when the bar-like abutting member 41 abuts against the inner edge of the toilet seat of the western style adult toilet bowl.

A fixed mounting part 46 is provided to the bottom surface of the auxiliary toilet seat main body 20, and is formed substantially rectangular cylindrical shape that is longer in a longitudinal direction, as shown in FIG. 2. A cover member 42 is fixed to the fixed mounting part 46 with a screw. A cover part 42*a* in a flat plate shape is formed on the cover member 42. A guide hole part 42*b* that is longer in the longitudinal direction is formed on the cover part 42*a* in the flat plate shape. The bar-like part 41*a* of the bar-like abutting member 41 is inserted into the guide hole part 42*b*. The bar-like abutting member 41 is guided by the guide hole part 42*b* in the longitudinal direction which is a moving direction. The bar-like abutting member 41 is restricted its downward movement by a top surface of the cover part 42*a* abutting against a bottom surface of the gear part 43*b*.

The meshing parts 42*c* are formed into the rack-like shape on the top surface of the cover part 42*a* at both sides of the cover part 42*a* and which extend with each other in the longitudinal direction. The each right and left meshing parts 42*c* are arranged so that the teeth of the each meshing parts 42*c* face each other. A slanted portions 42*c*1 are formed on at both sides of a top end of the each tooth of the meshing parts 42*c* at both sides. The slanted portions 42*c*1 are oppositely slanted each other so that a distal end of each tooth of the meshing parts 42*c* is formed at an acute angle. A top end of the meshing part 42*c* and a bottom surface of the base plate 44*a* define a predetermined gap S. The teeth of the meshing part 42*c* mesh with the teeth of the gear part 43*b*. By doing this, in a status shown in FIG. 5A, a longitudinal movement and a rotation around the axial center of the guide part 44*b* of the bar-like abutting member 41 are restricted since the gear part 43*b* meshes with the meshing parts 42*c* at both sides.

The gap S is slightly larger than a thickness of the gear part 43*b*, so that a meshing between the gear part 43*b* and the meshing parts 42*c* can be released. Therefore, the meshing between the gear part 43*b* and the meshing parts 42*c* is released when the gear part 43*b* is positioned in the gap S, as shown in FIG. 5B. In such a status, the bar-like abutting member 41 can move longitudinally along the guide hole 42*b* and is rotatable around the axial center of the guide part 44*b*. In transition from the status in which the meshing between the gear part 43*b* and the meshing part 42*c* is released to the status in which the gear part 43*b* meshes with the meshing part 42*c*, the teeth of the gear part 43*b* are guided by the slanted portions 42*c*1 of the meshing parts 42*c*, whereby the gear part 43*b* meshes with the meshing parts 42*c* smoothly. Other than a shape described in this embodiment, the slanted portion 42*c*1 can be formed such as curved outward and provided to one side of the meshing part 42*c* only. According to the fixing position adjusting means 60 with a structure heretofore described, the bar-like abutting member 41 can be moved in the longitudinal direction and rotated by the bar-like abutting member 41 being pushed against biasing force of the compression coil spring 45. In addition, when the bar-like abutting member 41 is released from being pushed, a position of the bar-like abutting member 41 can be fixed and a direction of the abutting part 41*b* can also be fixed.

Figure 6:
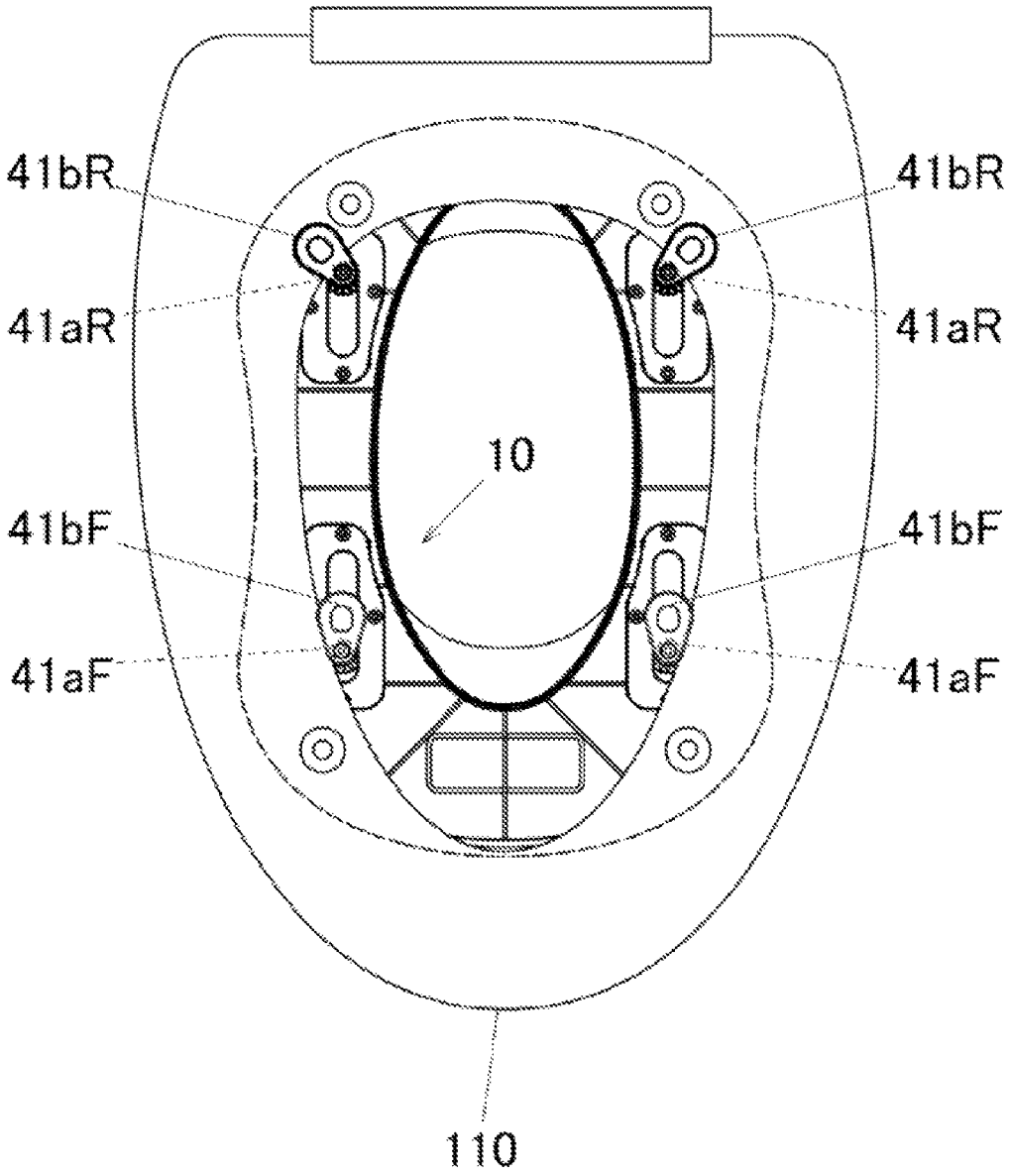
FIG. 6 is a bottom view of the auxiliary toilet seat of the present invention showing a state in which the auxiliary toilet seat is installed to an adult toilet seat.
Figure 7A:
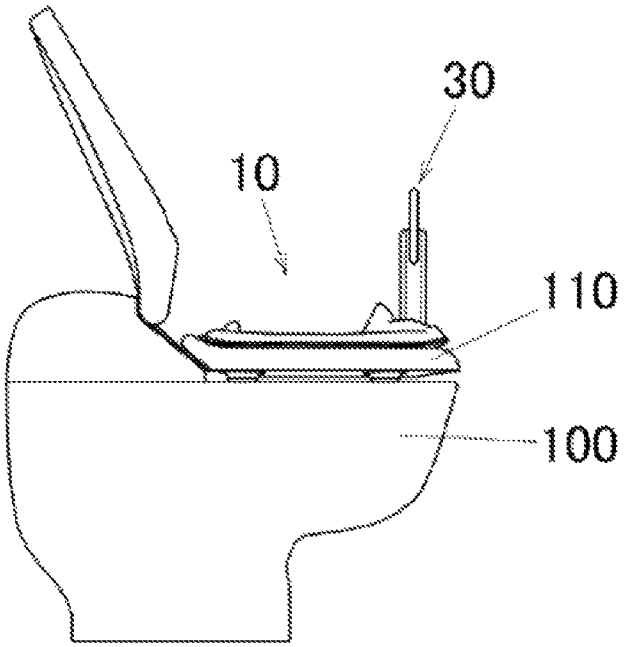
FIG. 7A, 7B are side views showing a state in which the auxiliary toilet seat of the present invention is installed to the adult toilet seat.

Next, installation of the auxiliary toilet seat 10 to the western style adult toilet bowl will be described. The auxiliary toilet seat 10 is installed to the western style adult toilet bowl with adjusting positions of a bar-like part 41*a*F and an abutting part 41*b*F of the bar-like abutting member 41 at two positions in a front side and positions of a bar-like part 41*a*R and an abutting part 41*b*R of the bar-like abutting member 41 at two positions in a rear side, as shown in FIG. 2. The installation of the auxiliary toilet seat 10 to a western style adult toilet bowl 100 will be described with reference to FIGS. 6, 7A, and 7B. FIGS. 6 and 7A show a status in that the auxiliary toilet seat 10 is installed to a toilet seat 110 of the western style adult toilet bowl 100 with the front side of the auxiliary toilet seat 10 being positioned forward of the western style toilet bowl 100.

When the auxiliary toilet seat 10 is installed to the toilet seat 110 with the front side of the auxiliary toiler sear 10 facing forward of the western style toilet bowl 100, initially, as shown in the FIG. 6, all the four bar-like abutting members 41 are moved to rearmost positions. At this time, the abutting parts 41*b*F at the two positions in the front side are individually oriented to an inside direction so as not to interfere with an opening of the toilet seat 110. In addition, the abutting parts 41*b*R of the bar-like abutting members 41 at the two positions in the rear side are individually made to be adjusted by being rotated so as to be abuttable against a bottom surface of the toilet seat 110. When doing this, the bar-like parts 41*a*R at the two positions in the rear side are individually abutted against an inner edge of the toilet seat 110.

In this state, the auxiliary toilet seat 10 is set on the toilet seat 110 with the abutting parts 41*b*R at the two positions in the rear side being inserted into the opening of the toilet seat 110. Next, the bar-like parts 41*a*F at the two positions in the front side is moved forward to be abutted against an inner edge of the toilet seat 110. By setting the auxiliary toilet seat 10 in this way, the abutting parts 41*b*R of the bar-like abutting member 41 in the rear side are abuttable against the bottom surface of the toilet seat 110, whereby the auxiliary toilet seat 10 is prevented from falling. In addition, the auxiliary toilet seat 10 is fixed to the toilet seat 110 by the bar-like parts 41*a*F in the front side being abutted against the inner edge of the toilet seat 110. The bar-like parts 41*a*F, 41*a*R in the front and rear parts are further adjusted by being moved according to a shape of the toilet seat 110 so as to fix the auxiliary toilet seat 10 to the toilet seat 110.

Figure 7B:
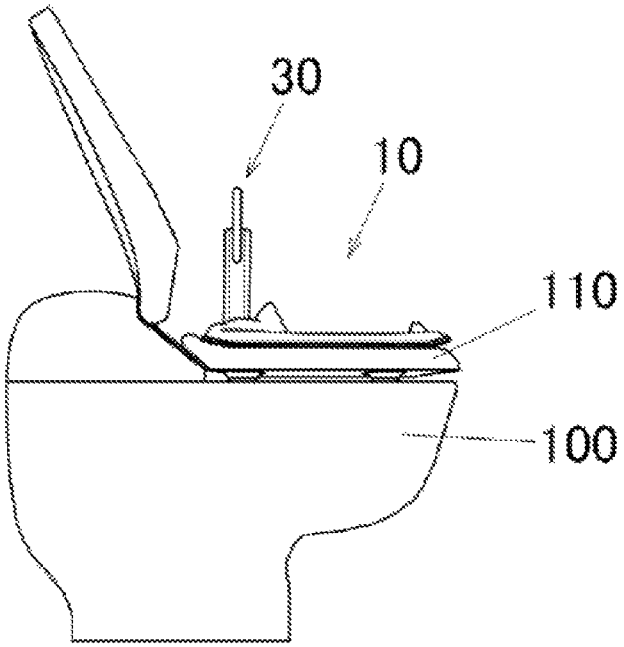

When setting the auxiliary toilet seat 10 on the toilet seat 110 of the western style adult toilet bowl 100 with the rear side of the auxiliary toilet seat 10 being positioned in the front side of the western style adult toilet bowl 100 (in other words, so that the handle part 30 locates in the rear side of the western style toilet seat 100) as shown in FIG. 7B, the abutting part 41*b*F in the front side is rotated to be adjusted so as to be abuttable against the bottom surface of the toilet seat 110 since the abutting part 41*b*F in the front side is positioned in the rear side of the toilet seat 110. Next, the bar-like part 41*a*R on the rear side is moved forward to abut against the inner edge of the opening of the toilet seat 110. The auxiliary toilet seat 10 is set on the toilet seat 110 of the western style adult toilet seat 100 in this way.

As described heretofore, the auxiliary toilet seat 10 can be installed with the handle part 30 being positioned forward or rearward in regard to the western style adult toilet bowl 100. When the auxiliary toilet seat 10 is installed to the toilet seat 110 with the handle part 30 being positioned forward as shown in FIG. 7A, the toddler can sit astride the auxiliary toilet seat 10 with gripping the handle part 30. At this time, as shown in FIG. 6, there is no obstacle in front of the toilet seat 110 of the western style adult toilet bowl 100, whereby the western style adult toilet seat 100 can be used as if it is the potty chair with the auxiliary toilet seat 10 being sat astride. On the other hand, when the auxiliary toilet seat 10 is installed to the toilet seat 110 with the handle part 30 being positioned rearward as shown in FIG. 7B, the toddler can sit on the auxiliary toilet seat 10 with the legs substantially closed, in the posture like sitting on the chair. As described above, the toddler can choose a sitting posture according to his/her preference when using the auxiliary toilet seat 10.

Figure 8:
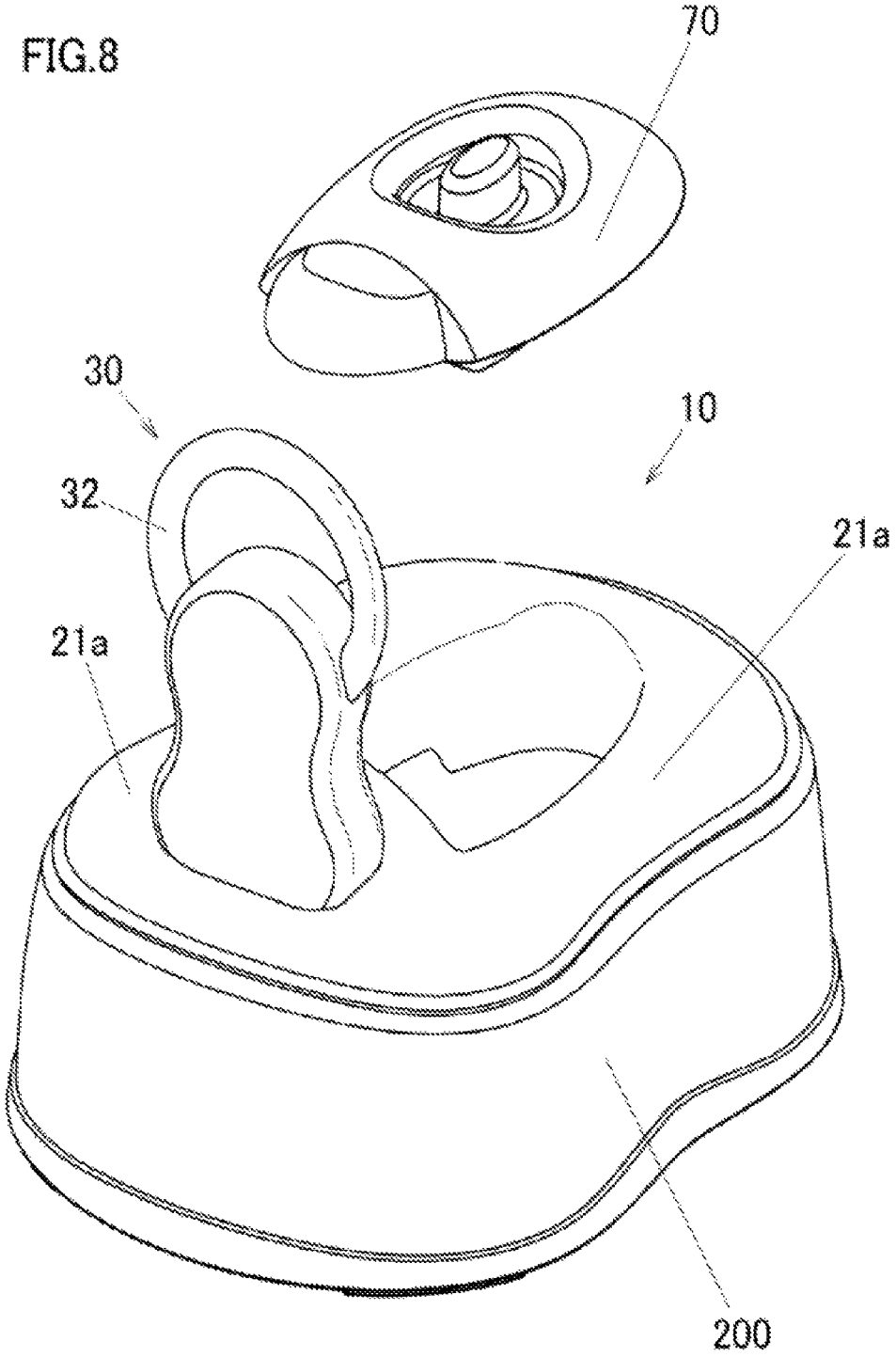
FIG. 8 is an external perspective view of the auxiliary toilet seat of the present invention showing a state in which the auxiliary toilet seat is used as a potty chair.

FIG. 8 shows a state in which the auxiliary toilet seat 10 is used as a potty chair with a chamber pot 200 being attached to a bottom side of the auxiliary toilet seat 10. An outer peripheral shape of the chamber pot 200 is formed to be substantially the same in plan view as the outer peripheral shape of the auxiliary toilet seat main body 20. A lid 70 can be set to cover the opening of the auxiliary toilet seat main body 20 of the auxiliary toilet seat 10. When being used as the potty chair, the toddler can also sit astride the auxiliary toilet seat 10 with gripping the handle part 30, or sit with the handle part 30 being in the toddler's back side because each of front/rear parts and right/left parts of the outline of the auxiliary toilet seat 10 are formed symmetry. The fringe area of the buttock supporting seating surface 21*a* on both sides is curved inward, whereby the auxiliary toilet seat 10 hardly interferes with the toddler's legs when the toddler sits astride the auxiliary toilet seat 10, and the auxiliary toilet seat 10 is comfortable to sit on when used as the potty chair.

As heretofore described, with the auxiliary toilet seat 10 of the present invention, the toddler can sit astride the auxiliary toilet seat 10 with gripping the handle part 30, or sit in the posture like sitting on the chair with the handle part 30 being in the toddler's back side. Consequently, the toddler can choose the sitting posture according to his/her preference. In addition, the auxiliary toilet seat 10 can be installed to the toilet seat 110 for adult with the same adjusting operation for both sitting postures, whereby a choice of the sitting posture can be made with ease.

The invention is not limited to the embodiment that has been described heretofore but can be modified or improved variously without departing from the spirit and scope of the invention. The novel embodiments can be carried out in other various forms. Thus, various omissions, replacements and alterations can be made without departing from the spirit and scope of the invention. The embodiments and their modifications are included in the spirit and scope of the invention and the scope of inventions described in claims and their equivalents.

For example, the compression coil spring 45 is used as the elastic member for biasing the bar-like abutting member 41 in this embodiment. However, other elastic member such as a leaf spring can also be used. In addition, the bar-like abutting member 41 is made to be moved and fixed in the longitudinal direction in this embodiment. However, the bar-like abutting member 41 can also be made adjustable in a lateral direction and an oblique direction according to a shape of the opening of the toilet seat 110.

What is claimed is:

1. An auxiliary toilet seat comprising:

an auxiliary toilet seat main body formed substantially oval comprising a seating surface having two buttock supporting surfaces, wherein the seating surface in a longitudinal direction is formed flat, and wherein a center portion of an exterior perimeter of each buttock supporting surface is curved inward to be narrower in width than non-center portions of each buttock supporting surface;

a handle provided only to a front part of the seating surface;

a support part formed on a bottom surface of the auxiliary toilet seat main body for supporting the auxiliary toilet seat main body by abutting against a toilet seat surface of an adult toilet bowl when the auxiliary toilet seat is set on the adult toilet bowl;

a bar-like abutting member provided to each of two positions in the front part and a rear part of the bottom surface of the auxiliary toilet seat main body, having a bar-like part formed into a vertically long bar-like shape so as to be abuttable against an inner edge of a toilet seat of the adult toilet bowl, and an abutting part projecting from a bottom end side of the bar-like part so as to be abuttable against the bottom surface of the toilet seat of the adult toilet bowl, wherein the bar-like abutting member is further configured such that the bar-like part and the abutting part are substantially L-shaped; and four fixing position adjusting means formed such that a fixing position of the each bar-like abutting member is adjustable by being moved and configured such that the auxiliary toilet seat can selectively be set in a forward or a rearward facing direction on the toilet seat surface of the adult toilet bowl, the fixing position adjusting means comprising:

a gear part fixedly provided to an upper end side of the bar-like abutting member;

a guide member provided above the gear part and configured to guide the bar-like abutting member rotatably around an axis thereof and in a vertical direction; and a cover member fixedly provided to the bottom surface of the auxiliary toilet seat main body, the cover member being formed into a flat plate-like shape configured to restrict a downward movement of the bar-like abutting member by abutting against the gear part.

2. The auxiliary toilet seat of claim 1, wherein the fixing position adjusting means further comprises:

an elastic member for biasing the guide member and the gear part in a separating direction; and a meshing part formed on a top surface of the cover member and which is formed into a rack-like shape extending in the moving direction of the bar-like abutting member at both sides of the gear part so as to mesh detachably with the gear part, wherein the guide member is configured to abut against the bottom surface of the auxiliary toilet seat main body, and wherein the cover member has a guide hole for guiding the bar-like abutting member in a moving direction.

3. The auxiliary toilet seat of claim 2, wherein a top end of a tooth of the meshing part is formed into a slanted shape.

4. The auxiliary toilet seat of claim 1, further comprising:

a splash prevention part which is formed into outwardly curved dome-like convex shape and which is provided to each front part and rear part of an inner peripheral part of a top surface of the auxiliary toilet seat main body, and in which the splash prevention part in the front part is made higher than the splash prevention part in the rear part, when viewed from a side.

5. The auxiliary toilet seat of claim 2, further comprising a splash prevention part which is formed into outwardly curved dome-like convex shape and which is provided to each front part and rear part of an inner peripheral part of a top surface of the auxiliary toilet seat main body, wherein the splash prevention part in the front part is made higher than the splash prevention part in the rear part, when viewed from a side.

6. The auxiliary toilet seat of claim 3, further comprising a splash prevention part which is formed into outwardly curved dome-like convex shape and which is provided to each front part and rear part of an inner peripheral part of a top surface of the auxiliary toilet seat main body, wherein the splash prevention part in the front part is made higher than the splash prevention part in the rear part, when viewed from a side.

* * * * *